United States Patent [19]

Prunier et al.

[11] Patent Number: 4,966,023

[45] Date of Patent: Oct. 30, 1990

[54] STAGED TOOL FOR BORING A HOLE IN AN ELEMENT BY AXIAL PENETRATION OF THE TOOL

[75] Inventors: Robert Prunier, Carpentras; Regis L. Ruiz, Dijon; J. Pierre Ravier, Quetigny, all of France

[73] Assignee: Agence Regionale De Developpements technologigues, Dijon, France

[21] Appl. No.: 231,875

[22] Filed: Aug. 12, 1988

[30] Foreign Application Priority Data

Aug. 13, 1987 [FR] France ..... 87 11554

[51] Int. Cl.[5] ..... B21C 23/32; B21C 25/04

[52] U.S. Cl. ..... 72/41; 72/266

[58] Field of Search ..... 72/41, 43, 44, 45, 97, 72/209, 267, 325, 370, 256, 264, 266

[56] References Cited

U.S. PATENT DOCUMENTS

| | | | |
|---|---|---|---|
| 880,563 | 3/1908 | McTear | 72/41 X |
| 1,843,395 | 2/1932 | Lauterbach | 72/97 |
| 3,777,528 | 12/1973 | Sirantoine | 72/41 |
| 4,031,738 | 6/1977 | Schonfeld et al. | 72/97 X |

FOREIGN PATENT DOCUMENTS

| | | | |
|---|---|---|---|
| 542043 | 8/1922 | France . | |
| 25.550 | 3/1923 | France . | |
| 1130759 | 2/1957 | France . | |
| 2067226 | 8/1971 | France . | |
| 45-9058 | 4/1970 | Japan | 72/41 |
| 54-109056 | 8/1979 | Japan . | |
| 56-151131 | 11/1981 | Japan | 72/41 |
| 522867 | 7/1976 | U.S.S.R. | 72/97 |
| 588029 | 1/1978 | U.S.S.R. | 72/97 |
| 741970 | 6/1980 | U.S.S.R. | 72/97 |
| 880545 | 11/1981 | U.S.S.R. . | |
| 1365510 | 9/1974 | United Kingdom . | |

OTHER PUBLICATIONS

Patent Abstracts of Japan, vol. 3; 128 (C-62), Oct. 24, 1979, page 146, C 62.

*Primary Examiner*—E. Michael Combs

*Attorney, Agent, or Firm*—Sandler, Greenblum & Bernstein

[57] ABSTRACT

A staged tool for boring a hole in a heated element of a material such as metal. The tool is adaptable to being axially forced and operation of the tool causes plastic deformation of the bored material. The tool successively includes, beginning at its front end, a front cylindrical or conical end portion having a first relatively small diameter, a neck followed by a working portion of evolving revolution having a right cross-section which increases in the direction of advancement of the tool, whose major base has a second diameter greater than the first diameter. To improve lubrication during boring, positioned on the neck at the rear of the front end portion is a mass of solid lubricant having a fusion point less than the temperature of the element during the piercing operation. The solid lubricant melts when the tool penetrates into the heated element and the contact surface between the element and the working element is constantly lubricated by a melted lubricating film.

54 Claims, 5 Drawing Sheets

STAGED TOOL FOR BORING A HOLE IN AN ELEMENT BY AXIAL PENETRATION OF THE TOOL

BACKGROUND OF THE INVENTION

1. Field of the Invention

The present invention relates to a tool for boring a hole in an element and, more particularly, to a staged tool for boring a hole in a heated element, which boring proceeds by axial penetration and which boring involves deformation of the material of the element being bored.

2. Discussion of Background and Relevant Information

A number of difficulties may be encountered when attempting to form a hole in a solid material. It is frequently desired to form such holes, especially in metallic elements. Such holes have been formed by tools that punch into and/or through the material; such holes have also been formed by forming a small pre-hole in the element and then by guiding a relatively large tool through the pre-hole. Difficulties arise because of constraints based on the resistance and rheology of the material being deformed, as well as because of friction and lubrication problems.

Staged tools have heretofore been developed to form holes in solid material. Examples of such tools are shown and described in Russian patent document No. A-880,545; Japanese patent document No. A-54109056; French patent document No. A-552,043; and French patent document No. E-25550. Each of the tools described in these various patents successively includes, beginning at the forward ends of the tools, a front end portion, which is cylindrical or conical; a neck; and a working portion having a right straight section of revolution which increases in the direction opposite to that of the advancement of the tool. These tools can be utilized with their working surfaces in direct contact with the wall of the hole pierced in the element or with a lubrication layer interposed between their working surfaces and the wall of the hole. If such a lubricant is utilized, it is generally positioned in the inlet of a pre-hole bored in the element, as is described, for example, in French patent document No. A 2 067 226, French patent document No. A 1 130 759, and British patent document No. A 1 365 510. Such lubrication systems have a shortcoming, that shortcoming being that the lubricant mass, e.g., a flexible sheet of glass, a sheet of glass fabric, or a cone of powder of an agglomerated glass, may be pushed, to a large degree, in front of the tool where it cannot properly perform its lubricating function.

SUMMARY OF THE INVENTION

The present invention attempts to overcome the shortcomings of the prior art by providing a combined staged tool, of particularly simple design, making it possible to perform all of the work in a single operation and with a better qualitative result.

The staged tool according to the present invention, which tool may be used to bore a hole in an element made of a material such as a metal, by axial penetration of the tool while hot, and plastic deformation of the material of the element, comprises successively, beginning at its front end, an end front end portion which is cylindrical or conical, of a first relatively small diameter, then at least one neck followed by a working portion of right cross section of revolution increasing in the direction opposed to that of the advancement of the tool, the working portion having a major base having a second diameter greater than that of the first diameter. The staged tool of the present invention is characterized in that the neck which is situated at the rear of the front end portion is provided, before penetration of the tool into the element, with a mass of lubricant in a solid state. This mass of lubricant has a melting point that is less than the temperature at which the element is at during the boring operation, so that the solid lubricant melts when the tool penetrates into the hot element. Accordingly, the contact surface between the element and the working portion is constantly lubricated by a melted lubrication film formed from the melted lubrication mass contained in the neck.

The generative line of the working portion of the tool can be linear, which would cause the working portion to have truncated conical shape. It can also be partially or totally nonlinear, e.g., totally or partially curved, in which case the working portion would have a pseudo-truncated conical shape. The tool according to the present invention may comprise a plurality of successive working portions. In such a case, total work may be distributed between or among these working portions as a function of the properties of the material (e.g., rheology, resistance, triaxial aptitude by cold-hammering or welding). In embodiments of the present invention that comprise a plurality of successive working portions, spaces are generally arranged between the working portions, which spaces are formed based on the kinetic crystalline restoration of the material and on the heating or cooling period of the surface subjected to the work. These spaces are utilized to establish reserves or deposits of lubricant, which may be under pressure, and the volume of these reserves is provided in relation with the surfaces of the working portions to be lubricated.

The combined tool according to the present invention has several advantages. From an economic point of view it allows for reduction in time of manufacture, cost of assembly and disassembly, ultimate cost of heating, and cost of effective transformation and of complexity of the sequencing (of production). The tool also makes it possible to increase the amount of force that may be generated by the basic machine because it lowers the amount of force necessary for deformation based on relubrication. It also makes it possible to have access to those which can undergo a single cycle, e.g., a single heating. From a qualitative point of view and, consequently, also from an economic point of view, it makes it possible to reduce the number of rejects by avoiding friction which generates grooves and tears, folds, and decentering, when working while hot. Further, movement of each working portion is facilitated because each successive working portion is guided over the path of the preceding working portion.

According to the present invention, a staged tool for boring a hole having a wall in an element that has been heated to a predetermined temperature by axial penetration of the tool in a desired direction, includes a front end portion having a first diameter; a first working portion having a lateral surface with a right cross-sectional area that increases in the direction opposite that in which the tool advances, the first working portion further having a major base with a second diameter, the second diameter being greater than the first diameter; and a first neck portion connecting the front end portion and the first working portion, the first neck portion adaptable to receive and hold a first solid lubricant having a melting point temperature lower than the predetermined temperature to which the element to be bored is heated. When this tool penetrates the heated element, the first lubricant melts and effectively lubricates contact areas between the first working portion of the tool and the heated element.

The first end portion may be cylindrically shaped or it may be conically shaped.

A staged tool according to the present invention may also include a second working portion having a lateral surface with a right cross-sectional area that increases in the direction opposite that in which the tool advances, the second working portion further having a major base with a third diameter, the third diameter being greater than the second diameter; and a second neck portion connecting the first working portion and the second working portion, the second neck portion adaptable to receive and hold a second solid lubricant having a melting point temperature lower than the predetermined temperature to which the element to be bored is heated.

Still further, a tool according to the present invention may include a thermally insulated layer interposed between the second solid lubricant and any portion of the tool the second solid lubricant may come into contact with during tool use.

The first neck portion of a tool according to the present invention may include a piston shaft having an end distant from the front end portion, and the tool may further include a piston connected to the end of the piston shaft distance from the front end portion; an internal chamber in which the piston is slidingly disposed, the chamber having a side closest to the front end portion; and a compression spring, the compression spring surrounding the piston shaft and being disposed in the internal chamber between the piston and the side closest to the front end portion. Even still further, a tool according to the present invention may include an annular piston slidably mounted around the second neck portion, the annular piston operable to retain the second solid lubricant held by the second neck portion between itself and the second working member, the annular piston having an outer surface that rubbedly engages the wall of the bored hole so as to slightly compress the second lubricant.

The first working portion may be axially movably mounted with respect to the second working member.

The second working portion may have portions defining an internal, cylindrical, axial chamber having a diameter substantially equal to the diameter of the second neck portion, which neck portion extends into the internal, cylindrical, axial chamber, and, further, wherein the second working member has portions defining a conduit between the chamber and the tool exterior, which conduit is adapted to be capped and which, in operation, would normally be capped and would not be uncapped until after engagement of the second working portion and the element to be bored.

The element to be bored may have a pre-hole that has been formed in it, the pre-hole having a certain diameter, and further, wherein the cylindrically shaped front end portion has a diameter substantially equal to the diameter of the pre-hole.

The element to be bored may have a conical pre-hole formed into it, wherein the front end portion comprises a conical center head which is adapted to measure centering of the tool and the conical pre-hole, and wherein the second working portion has a major rear base having a diameter corresponding to the desired final diameter of the hole bored in the element to be bored.

A tool according to the present invention may have a cylindrical front end portion and a cylindrical neck portion and, further, the first working portion may have a minor base to which the first neck portion is connected and a major base with a diameter corresponding to the desired final diameter of the hole bored in the element to be bored.

A tool according to the present invention may also include a first cylindrical guidance bearing surface, this first cylindrical guidance bearing surface having the same diameter as the major base of the first working portion and this first cylindrical guidance bearing surface extending the first working portion.

A tool according to the present invention may also include a second cylindrical guidance bearing surface, this second cylindrical guidance bearing surface having the same diameter as the major base of the second working portion and this second cylindrical guidance bearing surface extending the second working portion.

The element to be bored may have a pre-hole formed into it, the front end portion which engages the pre-hole may be rounded, the first neck portion may have a truncated conical shape having a curved generator and a concavity turned towards the exterior, and the first working portion may have a truncated conical shape having a rectilinear generator. In such a case the tool could include a second neck portion having a truncated conical shape and a concavity turned towards the exterior and a second working portion having a truncated conical shape having a rectilinear generator. During operation of such a tool, the first and second working working portions would be in simultaneous contact with the boundaries of the hole being bored in the element to be bored.

The first lubricant may include a crown of glass lubricant which is adapted to melt in the heated element. Likewise, the second lubricant may include a crown of glass lubricant which is adapted to melt in the heated element.

A lubricant may be predisposed in the mouth of the hole being bored, which hole may be conical, whereby, after melting, the lubricant could be enclosed in annular spaces defined by the first and second truncated conical portions having a curved generator so as to lubricate the first and second working portions.

According to the teachings of the present invention, a tool for boring includes a front end portion having a first diameter; a first working portion in the shape of a truncated cone with a minor base and major base, the major base having a second diameter which is greater than the first diameter, the minor base being positioned so as to be disposed closer to the front end portion than any other part of the first working portion; and a first neck portion interconnecting the front end portion and the first working portion.

A tool according to the present invention may also include a second working portion in the shape of a truncated cone with a minor base and a major base, the major base having a second diameter which is greater than the first diameter, the minor base being positioned so as to be disposed closer to the front end portion than any other part of the second working portion; and a second neck portion interconnecting the first working portion and the second working portion.

As stated before, the first lubricant may include a glass crown. Such a glass crown may include at least two crown portions, which at least two crown portions could be adapted to be maintained in place by attachments that disappear with heat. Alternatively, the two crown portions could be adapted to maintained in place by a sash of fusible fabric material. To facilitate their manufacture, the two crown portions may be half portions.

Both the first and second lubricants could include glass crowns. Both the first and second glass crowns each could include at least two crown portions, which at least two crowned portions could be adapted to be maintained in place by attachments that disappear with heat or by a sash of fusible fabric material.

BRIEF DESCRIPTION OF THE DRAWINGS

Other objects, advantages, and novel features of the present invention will become apparent from the following detailed description of the invention when considered in conjunction with the accompanying drawings wherein.

DETAILED DESCRIPTION OF THE INVENTION

Figure 1:
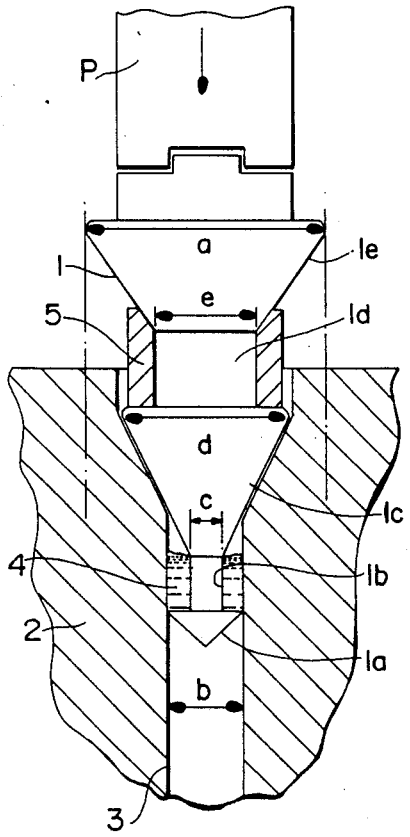
FIG. 1 is an axial cross-sectional view of a staged tool according to the present invention.
Figure 2:
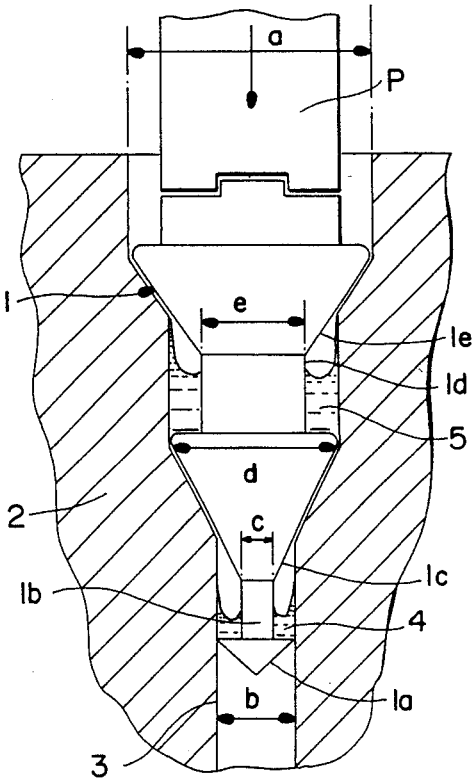
FIG. 2 is an axial cross-sectional view of a staged tool according to the present invention.

A staged tool 1 shown in FIGS. 1 and 2 is adapted to pierce a metallic element 2, which has first been brought to its forgoing temperature. The tool 1 pierces by an axial movement from top to bottom to produce a hole of large diameter a. A pre-hole 3, a smaller hole of diameter b, may or may not be formed before use of tool 1. Tool 1 is progressively driven axially into element 2 by being guided through pre-hole 3, if present, by means of a pusher P. Element 2 is maintained on the exterior, in a conventional manner, in a matrix or template (not shown).

The staged tool 1 shown in FIG. 1 comprises a plurality of portions of different diameters. At its lower or front end the tool 1 comprises a conical portion 1*a*, having a frontward facing point and whose rear base diameter is equal to the diameter b of the pre-hole 3. Front truncated conical portion 1*a* serves, in this case, only for guidance of the front end of the tool in the pre-hole 3. Above this extreme front end 1*a* is located a first cylindrical portion 1*b* of diameter c, which diameter c is less than the diameter b. To first cylindrical portion 1*b* is connected a first working portion 1*c*. This first working portion 1*c* has a lateral surface having a right cross-section which increases progressively upwardly, i.e., in the direction opposite to that direction in which the tool moves. First working portion 1*c* has, for example, a truncated conical shape, with a front small base of diameter c, through which it is connected to the cylindrical portion 1*b*, and a large rear base of a diameter d, which is less than the final diameter a. The large base of the first working portion 1*c* is extended towards the rear by a second cylindrical portion 1*d* of a diameter e less than the diameter d. To this second cylindrical portion 1*d* there follows a second working portion 1*e* which has a lateral surface having a right cross-section which increases upwardly, for example, in a truncated conical shape, connected through its small base of diameter e to the second cylindrical portion 1*d* and having a rear major base of diameter a. The angle at the apex of the first working truncated conical portion 1*c* is less than that of the second working truncated conical portion 1*e* which is thus more widened out than the preceding portion, as can be seen in FIGS. 1 and 2. However, this arrangement is not be taken as limiting and the angles at the apex of the two working portions could be the same or the angle at the summit of the first working portion 1*c* could be even greater than that of the second working portion 1*e*.

According to the present invention, the staged tool 1 is provided, before being engaged in the metallic element, with a lubricant which is positioned in the necks formed around the cylindrical portions 1*b* and 1*d* which respectively assure the attachment between the end conical portion 1*a* and the first truncated conical working portion 1*c* and between the first and second truncated conical portions 1*c* and 1*e*.

The lubricant constitutes two crowns 4 and 5 which are formed, on tool 1, respectively around two cylindrical portions 1*b* and 1*d*, before it is introduced into element 2. The two crowns 4 and 5 each preferably comprise two half-crowns made of glass obtained by molding of powder with an agglomerate or by casting, these two crowns 4 and 5 being maintained in place by attachments which disappear when heated. One can likewise utilize for this purpose a fabric sash of fusible material, for example, glass, joined at the same location.

The lower lubrication crown 4 which is positioned in the pre-hole 3 is found only in the melted state, i.e., in the position of the tool shown in FIG. 1. This is because crown 4 has, at that point, been brought to a temperature greater than the fusion point temperature of glass. As the tool 1 descends, this crown of melted glass 4 assures the lubrication of the contact surface between the element 2 and the first truncated conical working portion 1*c*. In FIG. 1, the upper crown of glass 5 is shown in the solid state since it is not yet engaged in element 2 and it is not yet heated sufficiently to be able to melt. On the contrary, this upper crown of glass 5 is likewise in the melted state, when it is engaged in element 2, as is shown in FIG. 2. This upper crown of melted glass 5 assures the lubrication in the contact zone between the metallic element 2 and the second working portion 1e.

Figure 3:
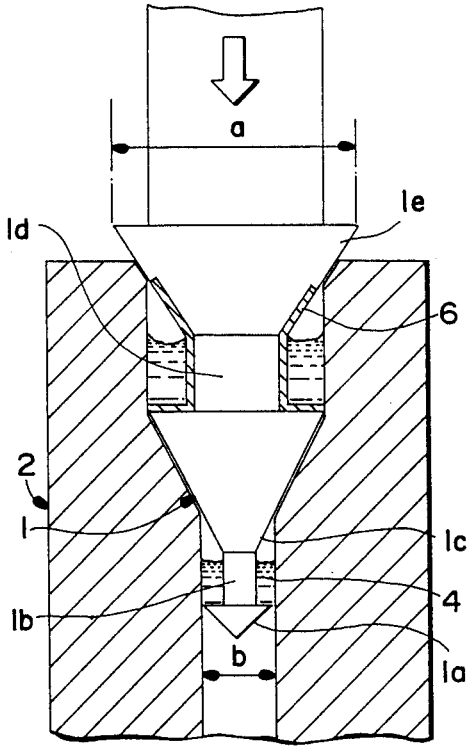
FIG. 3 is an axial cross-sectional view of an alternative embodiment of the staged tool according to the present invention.

In the embodiment of the invention shown in FIG. 3, a thermal insulation layer 6 which is adapted to facilitate the heating of the lubricant when the properties of the latter require it, is interposed between the lubrication crown 5 surrounding the second cylindrical portion 1d and the portion of the tool 1 with which this crown is in contact. This thermal insulation layer 6 extends on the annular shoulder formed at the connection between the upper major base of the first truncated conical working portion 1c and of the cylindrical portion 1d, all around the lateral surface of this cylindrical portion 1d, and the length of the lower portion of the lateral surface of the second truncated conical portion 1c.

Figure 4:
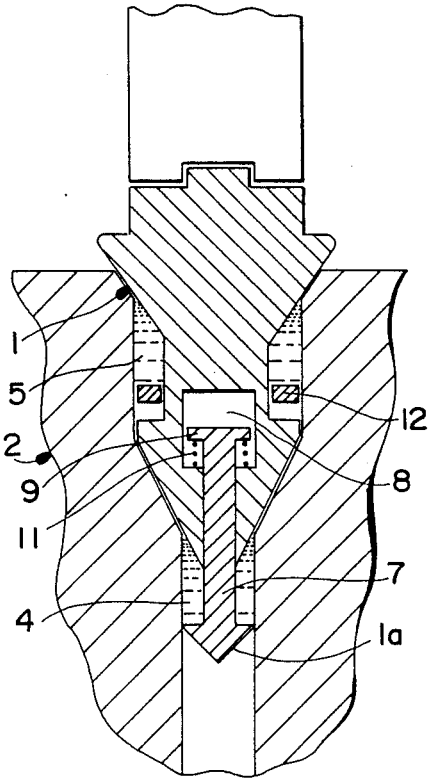
FIG. 4 is an axial cross-sectional view of an alternative embodiment of the staged tool according to the present invention.

In the embodiment of the invention shown in FIG. 4, the front truncated conical portion 1a of tool 1 is not an integral portion of the rest of the tool but it is affixed to a piston shaft 7 extending axially within the body of tool 1 to open into an internal chamber 8. In this chamber, shaft 7 ends in a piston 9 and a compression spring 11, surrounding shaft 7, is positioned between the piston 9 and the end of chamber 8. Under the effect of the spring, the piston 11 tends to push towards the top of shaft 7 and, consequently, the front end portion 1a which serves to compress the lubrication crown 4 surrounding the first cylindrical portion 1b, i.e., a mass of melted lubricant. In this embodiment, tool 1 further comprises an annular piston 12 mounted to slide freely around the second cylindrical portion 1d and which retains the lubrication crown 5 surrounding the second cylindrical portion 1d. Piston 12 which rubs on the lateral wall of the bored hole, is decelerated and thus contributes to the slight compression of the lubricant 5, which action helps assure lubrication of the contact surface of the second truncated conical working portion 1c.

Figure 5:
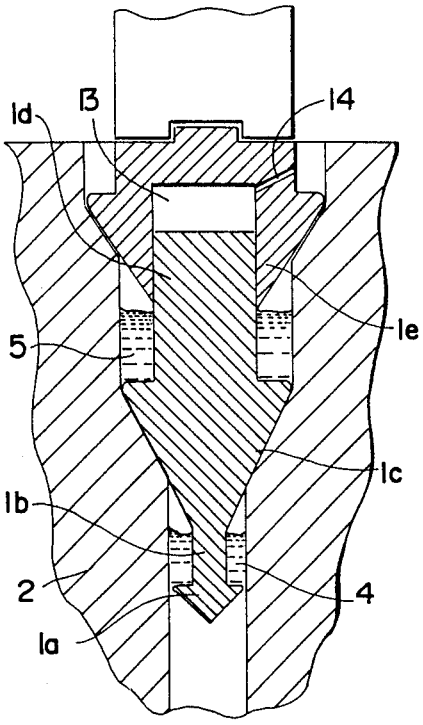
FIG. 5 is an axial cross-sectional view of an alternative embodiment of the staged tool according to the present invention.

In the embodiment of the invention shown in FIG. 5, the first truncated conical portion 1c is movably axially mounted with respect to the second truncated conical working portion 1e. To this end, the second cylindrical portion 1d which extends from the first truncated conical working portion 1c, forms a piston axially sliding within an axial chamber 13 of the same diameter provided in the second truncated conical working portion 1e and opening into the minor base of that portion. This chamber 13 communicates with the exterior through a conduit 14 which can normally be blocked and which is not unblocked until after engagement of the second working portion 1e in the element 2.

Figure 6:
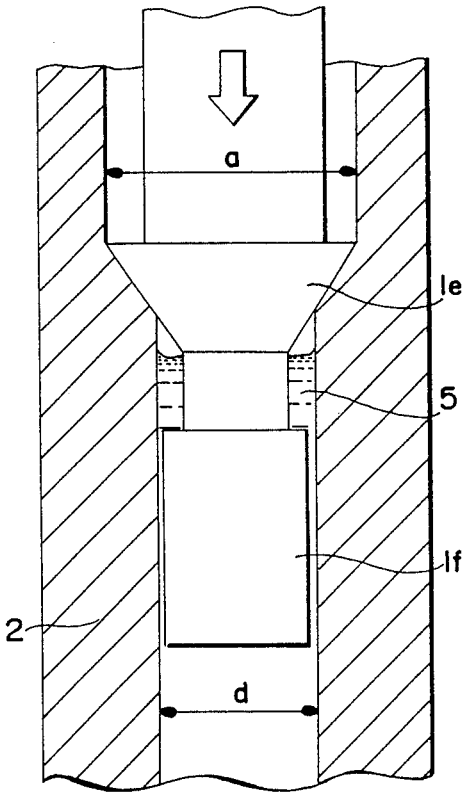
FIG. 6 is an axial cross-sectional view of an alternative embodiment of the staged tool according to the present invention.

In the embodiment of the invention shown in FIG. 6, the front conical end portion 1a and the first front working portion 1c are replaced by a front end cylindrical portion 1f of a diameter corresponding substantially to the diameter d of a pre-hole already resulting from a first operation. The cylindrical portion 1f assures the axial guidance of the tool which, by its upper truncated conical working portion 1e, enlarges the hole to the final diameter a.

Figure 7:
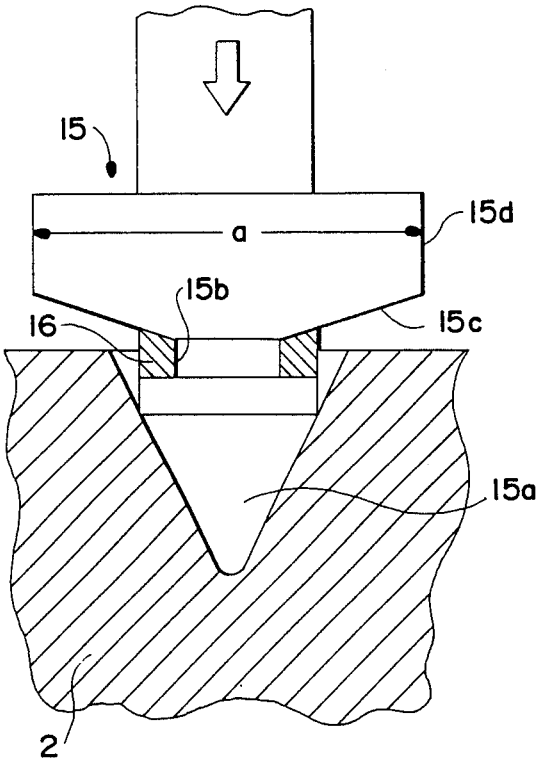
FIG. 7 is an axial cross-sectional view of an alternative embodiment of the staged tool according to the present invention.

In the embodiment of the invention shown in FIG. 7, tool 15 comprises a first front centering conical head 15a which is adapted to assure the centering of the tool in a conical pre-hole formed in element 2. Above this front centering head 15a tool 15 comprises an annular neck 15b containing a lubricating mass 16, for example a glass crown, and above the neck 15b a working portion 15c, of a truncated shape and whose major rear base has a diameter a corresponding to the final diameter which one desires to obtain for the hole. At the working portion 15c a cylindrical portion 15d of a diameter a follows whose role is to avoid deviation of the hole in the course of its being made.

Figure 8:
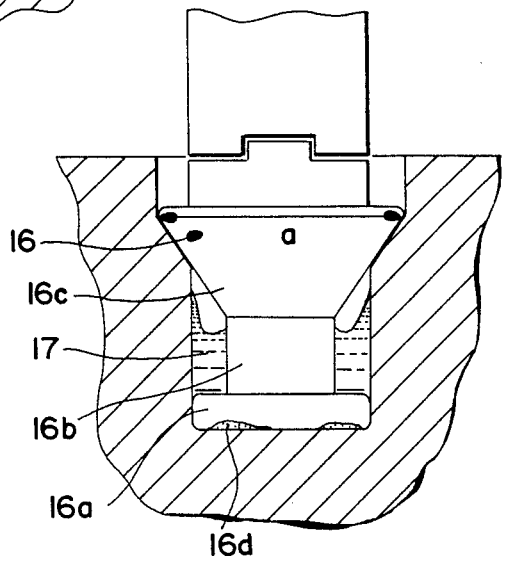
FIG. 8 is an axial cross-sectional view of an alternative embodiment of the staged tool according to the present invention.

In the embodiment of the invention shown in FIG. 8, tool 16 comprises a cylindrical head 16a followed by a cylindrical portion 16b of a smaller diameter, defining a neck containing a lubricating mass 17 such as melted glass. The head 16a preferably has, in its frontal surface, an annular cavity 16d centered on the axis and containing a small quantity of lubricant. At the rear of the cylindrical portion 16b extends the truncated conical working portion 16c whose front minor base is connected to the cylindrical portion 16b and whose rear major base defines the final diameter a of the bored hole.

Figure 9:
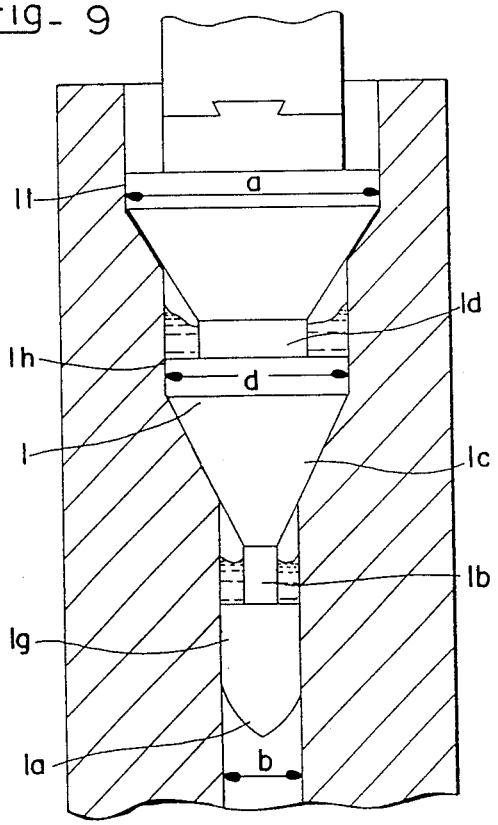
FIG. 9 is an axial cross-sectional view of an alternative embodiment of the staged tool according to the present invention.

In the embodiment of the invention shown in FIG. 9, tool 1 of FIGS. 1 and 2 has been modified such that the front end conical portion 1a is extended towards the rear by a bearing surface of cylindrical guidance 1g of diameter b connected to the first cylindrical portion 1b of smaller diameter. The major rear base of the first truncated conical working portion 1c is extended upwardly by a second bearing surface of cylindrical guidance 1h of diameter d, connected to the second cylindrical portion 1d, and the major rear base of the second truncated conical working portion 1e is extended by a third guidance bearing surface 1i of diameter a.

Figure 10:
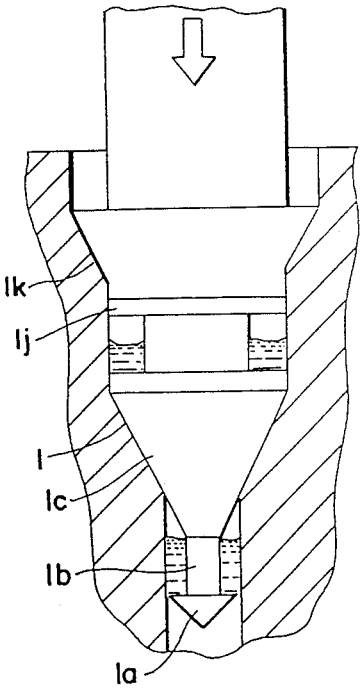
FIG. 10 is an axial cross-sectional view of an alternative embodiment of the staged tool according to the present invention.

In the embodiment of the invention shown in FIG. 10, tool 1 of FIG. 9 has been modified to present, above the second cylindrical portion 1d, a cylindrical guidance bearing surface 1i of the same diameter d as the bearing surface of cylindrical guidance 1h, which is followed by a working portion 1k having a non-linear generator, convex or concave, which can itself be followed, if desired, by a working portion 1l having a linear generator. The first working portion 1c could also have a totally or partially linear generator.

The tool shown in FIG. 10 has several advantages with respect to the distribution of lubricant. One avoids presenting a mass in the shape of a substantial hydraulic wedge, which can distort the shape of the working portions. The successive bores nest in one another without risk of deviation; thus, final centering is improved. Because one avoids movement of the edge of the initial hole, or of the one preceding it and losses of material, it is possible to diminish the size of the initial pre-hole, limited only by first lubricant needs.

Figure 11:
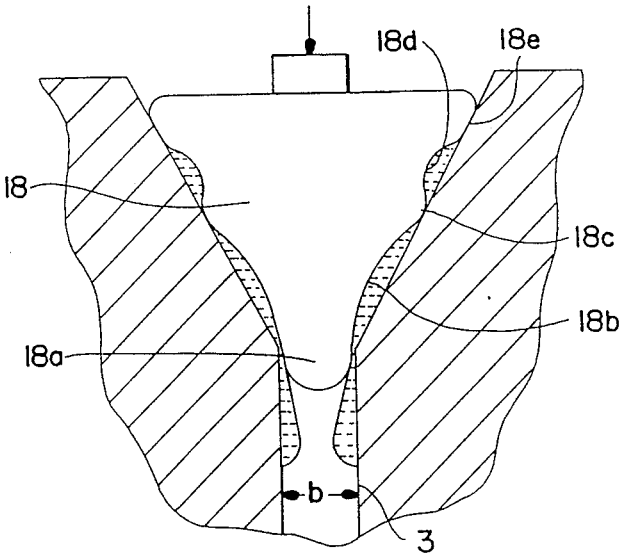
FIG. 11 is an axial cross-sectional view of an alternative embodiment of the staged tool according to the present invention.

In the embodiment of the invention shown in FIG. 11 tool 18 has a generally truncated conical shape having a point engaged in a pre-hole 3 of small diameter b. The front end portion 18a of the tool 18 which is engaged in the pre-hole 3 is rounded. It is extended towards the rear by a first portion of a truncated conical shape having a curved generator 18b, having a concavity turned toward the exterior, then a second truncated conical portion 18c having a rectilinear generator, then a third portion 18d of a truncated conical shape having a curved generator, having a concavity turned towards the exterior, then a fourth conical portion 18e, having a rectilinear generative line. In this embodiment the two working portions are constituted by two truncated conical portions 18c and 18e that are in simultaneous contact with the mouth of the cone in element 2. The lubricator is, in this case, simply predisposed in the mouth of the cone and, after melting, it is enclosed in the annular spaces defined by the two truncated conical portions 18b and 18d having a curved generative line to lubricate the two working portions 18c and 18c.

Obviously, many modifications and variations of this invention are possible in light of the above teachings. It is therefore to be understood that within the scope of the appended claims, the invention may be practiced otherwise than as specifically described.

We claim:

1. A staged tool for boring a hole in an element, that has been heated to a predetermined temperature, by axial penetration of the tool in a desired direction, said tool comprising:

a front end portion having a first diameter;

a first working portion with a cross-sectional area that increases from a second diameter to a third diameter to respectively define a minor base and a major base for said working portion, said second diameter being less than said first diameter of said front end portion, said minor base being positioned so as to be disposed closer to said front portion than any other part of said first working portion;

a first coupling portion interconnecting said front end portion and said first working portion, said first coupling portion having a fourth diameter which is less than said first diameter of said front end portion, and less than or equal to said second diameter of said first working portion, to thereby define a first reservoir;

a first lubricant located in said first reservoir prior to boring for progressively lubricating said first working portion during said axial penetration of said tool in said element.

2. A tool as recited in claim 1 wherein said front end portion is cylindrically shaped.

3. A tool as recited in claim 2 wherein the element to be bored has a pre-hole that has been formed in it, the pre-hole having a certain diameter and, further, wherein said cylindrically shaped front end portion has a diameter substantially equal to the diameter of the pre-hole.

4. A tool as recited in claim 3 further comprising a first cylindrical guidance bearing surface, said first cylindrical guidance bearing surface having said same diameter as the major base of said first working portion and said first cylindrical guidance bearing surface extending from said first working portion.

5. A tool as recited in claim 2 further comprising a first cylindrical guidance bearing surface, said first cylindrical guidance bearing surface having said same diameter as the major base of the first working portion and said first cylindrical guidance bearing surface extending from said first working portion.

6. A tool as recited in claim 1 wherein said front end portion is conically shaped.

7. A tool as recited in claim 6 further comprising a first cylindrical bearing surface, said first cylindrical guidance bearing surface having said same diameter as the major base fo the first working portion and said first cylindrical guidance bearing surface extending from said first working portion.

8. A tool as recited in claim 1 wherein the element to be bored has a conical pre-hole formed into it, wherein said front end portion comprises a conical center head for centering of said staged tool in the conical pre-hole, and wherein said first working portion has a major base having a diameter equal to the diameter of the hole to be bored in the element.

9. A tool as recited in claim 8 further comprising a first cylindrical guidance bearing surface, said first cylindrical guidance bearing surface having said same diameter as the major base of said first working portion and said first cylindrical guidance bearing surface extending from said first working portion.

10. A tool as recited in claim 1, wherein said front end portion is cylindrical, wherein said coupling portion is cylindrical, and wherein said first working portion has a minor base to which the first neck portion is connected and a major base having a diameter corresponding to the desired final diameter of the hole bored in the element to be bored.

11. A tool as recited in claim 10 further comprising a first cylindrical guidance bearing surface, said first cylindrical guidance bearing surface having said same diameter as the major base of said first working portion and said first cylindrical guidance bearing surface extending from said first working portion.

12. A tool as recited in claim 1 further comprising a first cylindrical guidance bearing surface, said first cylindrical guidance bearing surface having said same diameter as the major base of the first working portion and said first cylindrical guidance bearing surface extending from said first working portion.

13. A tool as recited in claim 1 wherein said first lubricant comprises a crown of glass lubricant which is adapted to melt in the heated element.

14. A tool as recited in claim 1 further comprising:

a second working portion in the shape of a truncated cone with a minor base and a major base, the major base having a second diameter which is greater than the first diameter the minor base being positioned so as to be disposed closer to said front end portion than any other part of said second working portion; and a second neck portion interconnecting said first working portion and said second working portion.

15. A tool as recited in claim 14 wherein said first lubricant comprises a glass crown and said second lubricant comprises a glass crown.

16. A tool as recited in claim 15 wherein said first and second glass crowns each comprise at least two half crown portions, which at least two half crown portions are adapted to be maintained in place by attachments that disappear with heat.

17. A tool as recited in claim 15 wherein said first and second glass crowns each comprise at least two half crown portions, which at least two half crown portions are adapted to be maintained in place by a sash of fusible fabric material.

18. A tool as recited in claim 1 wherein said first lubricant comprises a glass crown.

19. A tool as recited in claim 18 wherein said glass crown comprises at least two half crown portions, which at least two half crown portions are adapted to be maintained in place by attachments that disappear with heat.

20. A tool as recited in claim 18 wherein said glass crown comprises at least two half crown portions, which at least two half crown portions are adapted to maintained in place by a sash of fusible fabric material.

21. A tool for boring as recited in claim 1, wherein said first working portion is in the shape of a truncated cone.

22. A tool for boring as recited in claim 1, wherein said first reservoir has a predetermined volume, selected as a function of the surface of the first working portion to be lubricated.

23. A tool for boring as recited in claim 1, wherein said first coupling portion is cylindrical.

24. A boring apparatus as recited in claim 1, wherein said first lubricant is a solid lubricant.

25. A tool for boring as recited in claim 1, further comprising:

a second working portion with a cross-sectional area that increases from a fifth diameter to a sixth diameter to respectively define a minor base and a major base for said second working portion, said fifth diameter being less than said third diameter of said first working portion, the minor base being position so as to be disposed closer to said front end portion than any other part of said second working portion; and a second coupling portion interconnecting said first working portion and said second working portion, said second coupling portion having a seventh diameter which is less than said third diameter of said first working portion, and less than or equal to said fifth diameter of said second working portion, to thereby define a second reservoir; and, a second lubricant located in said second reservoir.

26. A tool as recited in claim 25 further comprising a thermally insulated layer interposed between the second lubricant and at least one of said first working portion and said second working portion.

27. A tool as recited in claim 26 wherein said first working portion is axially movably mounted with respect to said second working portion.

28. A tool as recited in claim 27 wherein said second working portion has portions defining an internal, cylindrical, axial chamber having a diameter substantially equal to the diameter of the second neck portion, which neck portion extends into the internal, cylindrical, axial chamber and, further, wherein said working member has portions defining a conduit between the chamber and tool exterior, which conduit is adapted to be capped and which, in operation, would normally be capped and would not be uncapped until after engagement of the second working portion and the element to be bored.

29. A tool as recited in claim 28 further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said second working portion.

30. A tool as recited in claim 27 further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said second working portion.

31. A tool as recited in claim 26 further comprising a first cylindrical bearing surface, said first cylindrical guidance bearing surface having the same diameter as said major base of said first working portion and said first cylindrical guidance bearing surface extending from said working portion, and a second cylindrical guidance bearing surface, said second cylindrical guidance bearing surface having the same diameter as said major base of said second working portion and said second cylindrical guidance bearing surface extending from said second working portion.

32. A tool as recited in claim 25 wherein said first coupling portion comprises a piston shaft having an end distant from the front end portion, said tool further comprising:

a piston connected to the end of the piston shaft distant from the front end portion;

an internal chamber in which said piston is slidingly disposed, said internal chamber having a side closest to said front end portion; and a compression spring, said compression spring surrounding the piston shaft and being disposed in said internal chamber between said piston and the side closest to said front end portion.

33. A tool as recited in claim 32 further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said working portion.

34. A tool as recited in claim 32 further comprising an annular piston slidably mounted around said second coupling portion, said annular piston operable to retain the second solid lubricant held by said second neck portion between itself and said second working portion, said annular piston having an outer surface that slidingly engages the wall of the bored hole so as to slightly compress the second lubricant.

35. A tool as recited in claim 34 further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said second working portion.

36. A tool as recited in claim 32 wherein said first working portion is axially movably mounted with respect to said second working portion.

37. A tool as recited in claim 36 wherein said second working portion has portions defining an internal, cylindrical, axial chamber having a diameter substantially equal to the diameter of the second neck portion, which neck portion extends into the internal, cylindrical, axial chamber and, further, wherein said second working member has portions defining a conduit between a chamber and a tool exterior, which conduit is adapted to be capped and which, in operation, would normally be capped and would not be uncapped until after engagement of a second working portion and the element to be bored.

38. A tool as recited in claim 37 further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said second working portion.

39. A tool as recited in claim 36 further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said second working portion.

40. A tool as recited in claim 25 wherein said first working portion is axially movably mounted with respect to said second working portion.

41. A tool as recited in claim 40 wherein said second working portion has portions defining an internal, cylindrical, axial chamber having a diameter substantially equal to the diameter of the second neck portion, which neck portion extends into the internal, cylindrical, axial chamber, and, further, wherein said second working member has portions defining a conduit between the chamber and the tool exterior, which conduit is adapted to be capped and which, in operation, would normally be capped and would not be uncapped until after engagement of the second working portion and the element to be bored.

42. A tool as recited in claim 41 further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said second working portion.

43. A tool as recited in claim 40 further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said second working portion.

44. A tool as recited in claim 25, further comprising a first cylindrical guidance bearing surface, said first cylindrical guidance bearing surface having the same diameter as said major base of said first working portion and said first cylindrical guidance bearing surface extending from said first working portion, and a second cylindrical guidance bearing surface, said second cylindrical guidance bearing surface having the same diameter as said major base of said second working portion and said second cylindrical guidance bearing surface extending from said second working portion.

45. A tool as recited in claim 25 wherein said first and second lubricants comprise crowns of glass lubricant which are adapted to melt in the heated element.

46. A tool for boring as recited in claim 25, wherein said second reservoir has a predetermined volume, selected as a function of the surface of said second working portion to be lubricated.

47. A tool for boring as recited in claim 25, wherein said second working portion is in the shape of a truncated cone.

48. A tool for boring as recited in claim 25, wherein said second coupling portion is cylindrical.

49. A boring apparatus as recited in claim 25, wherein said second lubricant is a solid lubricant.

50. A tool for boring as recited in claim 25, further comprising a second lubricant located in said second reservoir prior to boring for progressively lubricating said second working portion during said axial penetration of said tool in said element.

51. A staged tool for boring a hole in an element which has been heated to a predetermined temperature, by axial penetration in any direction, wherein said element to be bored has a prehole formed into it, said tool comprising:

a front end portion, which is rounded, and engages the prehole;

a first coupling portion which as a substantially truncated conical shape having a first curved, inwardly extending exterior surface defining a first outwardly facing concavity;

a first working portion which has a truncated conical shape defined by a rectilinear generative line;

a second coupling portion which has a substantially truncated conical shape having a second curved, inwardly extending exterior surface defining a second outwardly facing concavity; and a second working portion which has a truncated conical shape defined by a rectilinear generative line, further wherein, in operation, the first and second working portions are in simultaneous contact wit the boundaries of said hole being bored in said element.

52. A tool as recited in claim 51 further comprising a lubricant predisposed in said hole being bored, said hole having a conical mouth, whereby, after melting, said lubricant is enclosed in an annular space defined by said conical mouth and said first and second truncated conical portions having said curved surfaces so as to lubricate the first and second working portions.

53. A staged tool extending in an axial direction for boring a hole in an element by penetration of the tool in said axial direction, said tool comprising:

a front end portion having a first diameter at a surface of said front end portion substantially perpendicular to said axial direction;

a first working portion with a cross-sectional area that increases from a second diameter to a third diameter to respectively define a minor base and a major base for said working portion, said second diameter being less than said first diameter of said front end portion, said minor base being positioned so as to be disposed closer to said front portion than any other part of said first working portion;

a first coupling portion interconnecting said front end portion at said substantially perpendicular surface and said first working portion, said first coupling portion having a fourth diameter which is less than said first diameter of said front end portion, and less than or equal to said second diameter of said first working portion, to thereby define a first reservoir for a first lubricant.

54. A tool for boring as recited in claim 53, further comprising:

a second working portion with a cross-sectional area that increases from a fifth diameter to a sixth diameter to respectively define a minor base and a major base for said second working portion, said fifth diameter being less than said third diameter of said first working portion, the minor base being position so as to be disposed closer to said front end portion than any other part of said second working portion; and a second coupling portion interconnecting said first working portion and said second working portion, said second coupling portion having a seventh diameter which is less than said third diameter of said first working portion, and less than or equal to said fifth diameter of said second working portion, to thereby define a second reservoir for a second lubricant.

* * * * *